United States Patent [19]

Martin

[11] Patent Number: 4,970,982

[45] Date of Patent: Nov. 20, 1990

[54] COMBINATION LIVEWELL AND BAIT WELL FOR FISHING BOATS

[75] Inventor: Robert L. Martin, Springfield, Mo.

[73] Assignee: Tracker Marine Corporation, Springfield, Mo.

[21] Appl. No.: 351,396

[22] Filed: May 15, 1989

[51] Int. Cl.[5] ..... B63B 35/14

[52] U.S. Cl. ..... 114/255; 114/343; 43/56

[58] Field of Search ..... 114/255, 343, 125; 43/55, 57; 261/121.2

[56] References Cited

U.S. PATENT DOCUMENTS 3,357,127 12/1967 Barradale ..... 43/55
3,509,657 5/1970 Bross, Jr. ..... 43/57
4,074,651 2/1978 Ardoser ..... 114/255
4,275,522 6/1981 Glover ..... 43/56

*Primary Examiner*—Joseph F. Peters, Jr.
*Assistant Examiner*—Edwin L. Swinehart
*Attorney, Agent, or Firm*—Kokjer, Kircher, Bradley, Wharton, Bowman & Johnson

[57] ABSTRACT

In a fishing boat, a built-in tank which serves the combined function of a livewell for holding fish that are caught and a bait well for receiving a minnow bucket. An electric pump powered by the battery of the boat pumps water from the lake into the tank in a manner to aerate the water and circulate it in the tank. A drain tube drains off water from the tank and prevents overflow. One half of the tank serves as a bait well in which a minnow bucket may be suspended. The other half of the tank is a livewell which receives newly caught fish. The livewell and bait well have separate hinged lids.

20 Claims, 1 Drawing Sheet

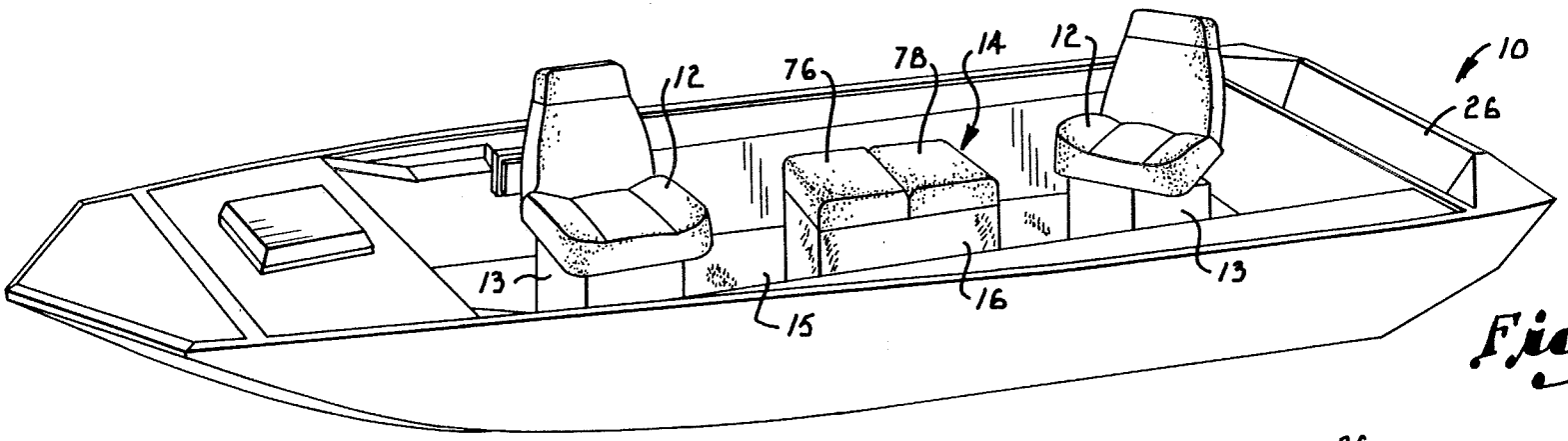
Fig. 1.
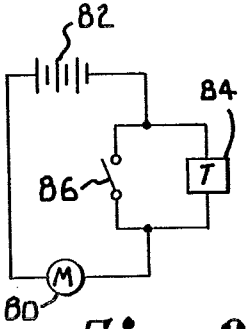
Fig. 3.
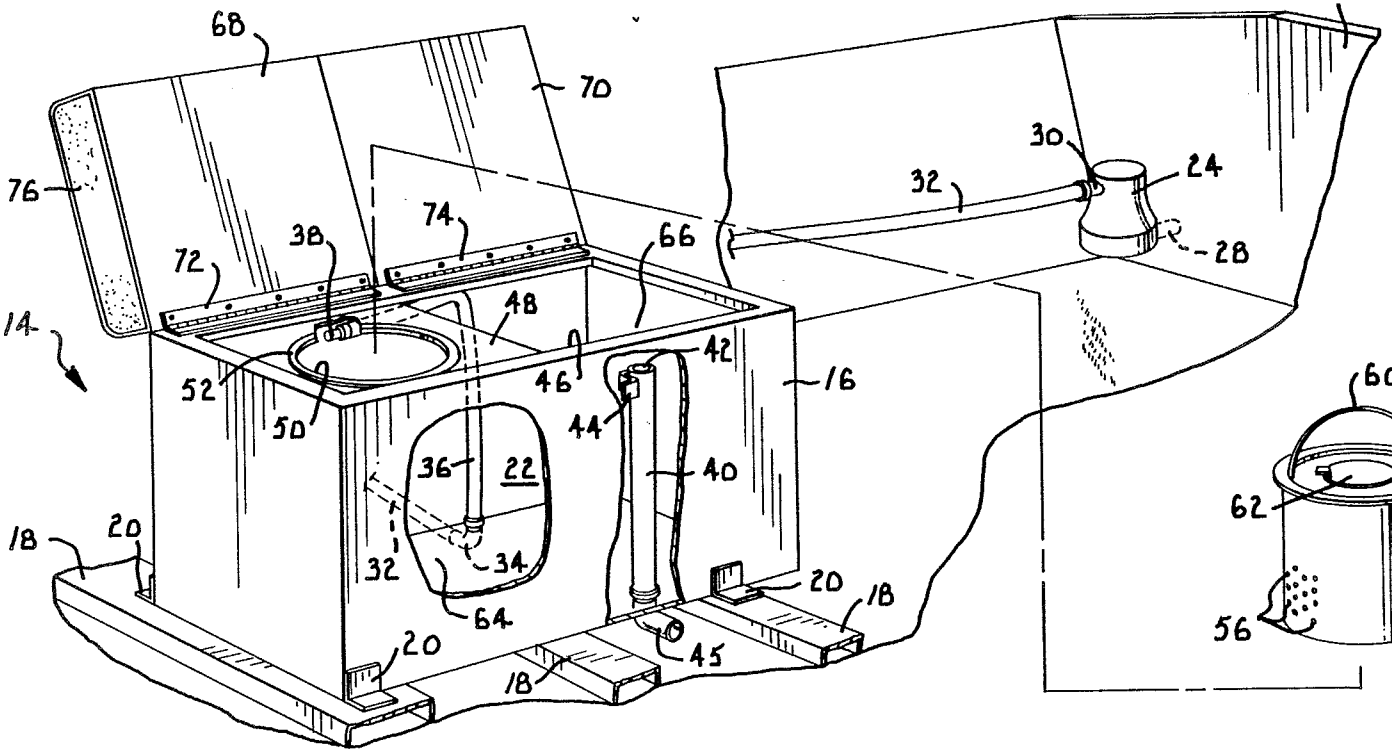
Fig. 2.
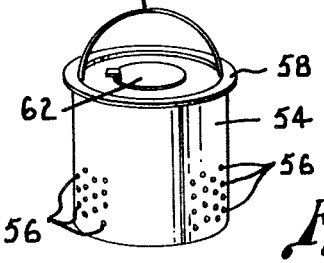

COMBINATION LIVEWELL AND BAIT WELL FOR FISHING BOATS

BACKGROUND AND SUMMARY OF THE INVENTION

This invention relates generally to fishing boats and more particularly to a structure that serves both as a livewell for storing freshly caught fish and as a bait well for storing a minnow bucket.

In bass tournaments and other fishing tournaments, it is a common requirement that the fish that are caught must be maintained in a live condition and released back into the lake or other body of water at the end of the tournament. Because of this and also to permit fish to be caught and kept alive in good physical condition for extended periods, some boats are provided with built-in livewells. The livewell is essentially a water tank in the boat that is large enough to hold the fish that are caught. Typically, water is circulated in the livewell by drawing water from its bottom portion and spraying water back in at the top above the water. Spraying the water through the air above the water level aerates the water so that air is made available to the fish in the livewell.

Minnows and other live bait are popular for use in fishing for crappie and various other small fish. The minnows are usually carried in a minnow bucket which is tied on a rope and suspended in the water over the side of the boat. The minnow bucket has holes in its side so that it fills with water when submerged.

In order to avoid harming the minnows, the minnow bucket must be pulled into the boat each time the boat travels between locations, and it must be thrown back over the side of the boat each time a new destination is reached. As can easily by appreciated, this procedure is cumbersome and detracts from the enjoyment of fishing. In addition, if the minnow bucket is inadvertently left hanging in the water while the boat travels at a significant speed, the minnows are destroyed.

The present invention is directed to a built-in well which serves the combined function of a livewell and bait well in a fishing boat. In accordance with the invention, a water tight tank is provided in a convenient location accessible to fishermen sitting on the fishing seats in the boat. An electric pump is operated by the battery of the boat and pumps fresh water from the lake into the well compartment. An overflow tube has a drain opening located near the top of the well compartment to drain off water so that the water level in the tank is maintained at the level of the drain opening. The water is delivered into the well compartment through a spray nozzle which sprays it into the air above the water level in order to aerate the water. Additionally, the nozzle is arranged to cause the water to move in a swirling pattern in order to keep it circulating. The pump can be cycled on and off by a timer switch, or it can be controlled by a manual switch.

Both a livewell and a bait well are provided in the well compartment. A panel having an opening sized to receive a minnow bucket permits the minnow bucket to be suspended from the panel with the bucket submerged in the water. The panel occupies only part of the well compartment, and the rest of the compartment remains unobstructed and provides room for live fish that have been caught. Consequently, the unit allows both newly caught fish and live bait to be maintained in a good condition in the aerated water contained in the well compartment. At the same time, the minnow bucket is readily accessible so that the fishermen can reach the bait from their fishing seats. Preferably, each half of the well compartment has its own hinged lid, and the lids can be provided with seat cushions so that they function as spare seats in the boat.

DETAILED DESCRIPTION OF THE INVENTION

In the accompanying drawings which form a part of specification and are to be read in conjunction therewith and in which like reference numerals are used to indicate like parts in the various views:

FIG. 1 is a perspective view of a fishing boat equipped with a combined livewell and bait well constructed according to a preferred embodiment of the present invention;

FIG. 2 is a fragmentary perspective view of the combined livewell and bait well on an enlarged scale, with the lids open and portions broken away for purposes of illustration; and FIG. 3 is a schematic diagram of the electric circuit used to control the pumping of water into the combined livewell and bait well.

Referring to the drawings in more detail and initially to FIG. 1, numeral 10 generally designates a fishing boat having a pair of fishing seats 12 in which fishermen normally sit. Each seat 12 can swivel on a pedestal 13. In accordance with the present invention, a combined livewell and bait well unit which is generally identified by numeral 14 is mounted on the floor 15 of the boat at a location approximately midway between the two seats 12.

Referring additionally to FIG. 2, the body of unit 14 takes the form a generally rectangular tank 16 which is water tight. The tank 16 may be mounted to structural cross members 18 of the boat by means of angle brackets 20. The tank 16 presents within it a well compartment 22 which normally contains aerated water.

The water is pumped into the well compartment 22 by a DC electric pump 24 mounted near the stern 26 of the boat. Pump 24 has an intake 28 which extends through the stern 26 at a location below the water level when the boat is disposed in a lake or other body of water. Consequently, pump 24 draws water from the lake or other body of water.

The discharge 30 of pump 24 connects with a flexible supply conduit 32 which extends along one side of the boat at a concealed location, The conduit 32 extends beneath the floor of the boat and connects with an elbow fitting 34 which extends into the tank 16 through the bottom. The downstream end of the elbow fitting 34 connects with an L shaped flexible conduit 36 carrying a spray nozzle 38 on its end.

The water level in the well compartment 22 is controlled by a vertical overflow tube or drain pipe 40 having a drain opening 42 in its upper end. The drain tube 40 is mounted to the inside surface of one side of tank 16 by a mounting bracket 44, with the drain opening 42 located near but slightly below the top of the tank 16. The bottom end of the drain tube 40 connects with an elbow 45 which in turn connects with a drain system that directs water out of the boat 10.

It is noted that the spray nozzle 38 is located slightly above the drain opening 42 but still within the tank 16. Consequently, the water that is sprayed from the spray nozzle 38 passes through the air above the water level in the tank and is thus aerated so that the water that enters the tank is relatively rich with air. The nozzle 38 is also oriented and arranged to direct the incoming water generally along one side of the tank 16 near one end. This orientation of the nozzle causes the incoming water to swirl as it is sprayed into the tank 16, and the incoming water thus circulates the water in tank 16 in a swirling or whirlpool pattern to enhance the water circulation in the tank.

Tank 16 has a rectangular top access opening 46 which provides access to the well compartment 22. A square panel 48 covers approximately one-half of the top of the tank 16. The panel 48 is generally rectangular and is provided with a central round opening 50 surrounded by a circular rim 52. The opening 50 is large enough to receive the body of a conventional minnow bucket 54. The minnow bucket 54 has openings 56 in its side to permit the bucket to fill with water when submerged. An enlarged collar or flange 58 is provided on the top portion of the minnow bucket and is too large to fit through the opening 50. Consequently, the minnow bucket can be extended through the opening 50 with its body submerged in the water in the well compartment 22 and with the flange 58 resting on rim 52 to suspend the minnow bucket in the tank. The minnow bucket 54 has the usual handle 60 and a hinged lid 62 which can be opened to provide access to the minnows that are held in the minnow bucket.

In this manner, the portion of the well compartment 22 which underlies the panel 48 serves as a bait well 64 which receives the bait carried in the minnow bucket. The remaining one-half of the volume of the well compartment 22 remains unobstructed and unoccupied by the bait to provide a livewell 66 for receiving newly caught fish.

A pair of lids 68 and 70 are connected with the top of the tank 16 by piano hinges 72 and 74, respectively. Lid 68 can be closed to a horizontal position in which it covers the panel 48 and the underlying bait well 64. The lid 68 can be opened about the hinge axis to the fully open position shown in FIG. 2. The other lid 70 similarly can be closed to cover the livewell 66 which underlies it or moved about its hinge 74 to the fully open position shown in FIG. 2. Preferably, the lids 68 and 70 are covered by suitable cushions 76 and 78, respectively. When the lids are closed, the unit 14 provides spare boat seats in that persons can sit on the cushions 76 and 78 if desired.

Referring now to FIG. 3, the pump 24 is driven by a DC electric motor 80 which receives electrical power from the main battery 82 of the boat. Arranged in parallel between the battery 82 and motor 80 are an automatic timer switch 84 and a manual on/off switch 86. Switch 86 can be opened and closed manually in order to respectively interrupt and complete the electric circuit to control the operation of the motor 80. The timer switch 84 can be set to complete the circuit for a selected time interval and to then interrupt the circuit for another time interval. In this manner, the operation of the pump can be controlled either manually by means of the manual switch 86 or automatically in timed cycles by means of the timer switch 84.

In operation, the pump 24 acts, when energized, to pump water from the lake or other body of water through the delivery conduits 32 and 36 to the spray head 38. The water is then sprayed through the air above the water level in tank 16, and spraying of the water through the air aerates the water to maintain the water in the tank in an air rich condition. When the water level rises to the level of the drain opening 42, the entry of additional water into the well compartment 22 causes water to drain off through the drain opening and the drain pipe 40 such that it is eventually discharged back into the lake or other body of water.

Live fish which are caught can be placed in the livewell 66 by opening lid 70 and then inserting the fish into the livewell through access opening 46. The minnow bucket can be placed in the bait well 64 and can be easily reached from either of the fishing seats 12 when more bait is needed. Because the water in the well compartment 22 is replenished by the operation of the pump 24 and remains aerated, both the live fish and the bait are maintained in good condition at all times. It is also pointed out that the livewell 66 provides adequate room for the fish even when the minnow bucket 54 is in place in the bait well.

While it is preferred that the unit 14 be located between the two fishing seats 12 so that fishermen seated in either seat have ready access to its contents, the unit can be situated in other locations such as in the stern or bow where only one of the fishermen has easy access to it. It should also be noted that a single lid can be provided for the unit 14 and that the lid need not necessarily be functional as a seat.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. In a fishing boat, a combination livewell and bait well comprising:

a substantially water tight well compartment in the boat;

a water supply conduit leading to said well compartment to supply fresh water thereto;

pump means having an intake side communicating with a body of water in which the boat is disposed and a discharge side communicating with said supply conduit;

a drain pipe having a drain opening in said well compartment at a preselected level, said drain pipe acting to drain water from the compartment to maintain the water level therein at said preselected level; and means in said well compartment for receiving a live bait container in a position to maintain the bait therein submerged in the water in the compartment while leaving the remaining portion of the compartment which is unoccupied by the bait container accessible to live fish in the compartment to permit fish which are caught to be stored in a live condition in said well compartment and to have access to said remaining portion of the compartment but not to the bait in said bait container.

2. The combination of claim 1, including means for aerating the fresh water supplied to the well compartment.

3. The combination of claim 2, wherein said aerating means comprises a spray nozzle on said supply conduit for discharging the fresh water therefrom, said nozzle being located above said drain opening to spray the water in the air above the water level in said well compartment.

4. The combination of claim 3, wherein said nozzle is oriented and arranged to effect swirling of the water supplied to the well compartment.

5. The combination of claim 1, wherein:

the boat has a battery;

said pump means includes an electrical pump motor and an electrical circuit for electrically connecting the battery with the pump motor for powering the latter;

said circuit includes switch means for completing said circuit to energize the pump motor and interrupting the circuit to deenergize the pump motor.

6. The combination of claim 1, wherein said means for receiving a live bait container comprises a panel having an opening through which the bait container may be extended into the water.

7. The combination of claim 1, including:

a top access opening in said well compartment providing access to the compartment; and a lid on said well compartment for opening and closing said access opening.

8. The combination of claim 7, wherein said lid comprises two separate lid sections each movable between open and closed positions independently of the other, one lid section generally overlying a bait container in the well compartment and the other lid section generally overlying said selected portion of the compartment.

9. In a fishing boat having at least one seat for a fisherman, a combination livewell and bait well comprising:

a substantially water tight well compartment in the boat, said compartment having a top access opening within reach of a fisherman seated in said seat;

a lid on said well compartment for opening and closing said access opening;

pump means for pumping fresh water into said well compartment;

a drain pipe having a drain opening in said well compartment at a preselected level and acting to drain water from the compartment when the water level therein reaches said preselected level; and first and second portions of said well compartment for respectively receiving live bait and live fish which have been caught, said first portion of the compartment having a size to receive a live bait container in a manner to maintain bait therein submerged while leaving said second portion unoccupied to receive live fish which have been caught, with said first and second portions being accessible to the live fish inserted into the compartment in the second portion.

10. The combination of claim 9, wherein said lid comprises a pair of separate lid sections each movable between open and closed positions independently of the other, one lid section being located to open and close the first portion of the well compartment and the other lid section being located to open and close the second portion of the well compartment.

11. The combination of claim 9, wherein said pump means comprises means for aerating the fresh water pumped into the well compartment.

12. The combination of claim 9, wherein said pump means comprises:

an electric pump having a discharge side and an intake side disposed to receive water from a body of water; and a water supply conduit extending in the boat from the discharge side of the pump to the well compartment.

13. The combination of claim 12, including a spray nozzle on said supply conduit located in the well compartment above said drain opening to spray water into the compartment in the air above the water level therein.

14. The combination of claim 13, wherein said nozzle is oriented and arranged to effect swirling of the water in the well compartment.

15. The combination of claim 12, wherein:

the boat includes a battery;

said pump means includes an electric pump motor and an electric circuit having a completed condition wherein the battery is electrically connected with said pump motor to energize same and an interrupted condition wherein the battery is electrically disconnected from the pump motor to deenergize same; and said circuit includes switch means for selectively effecting the completed and interrupted conditions of the circuit.

16. In a fishing boat, a combination livewell and bait well comprising:

a water tight tank presenting a substantially rectangular well compartment therein and having a top access opening;

lid means on said tank for opening and closing said access opening;

pump means for pumping fresh water into said well compartment from a body of water in which the boat is disposed;

a drain pipe having a drain opening in the well compartment at a preselected level to maintain the water level in the well compartment at said preselected level; and a panel in said tank presenting an opening through which a minnow bucket may be extended into the water beneath the panel, said panel defining a bait portion of the well compartment beneath the panel and leaving the remainder of the well compartment unoccupied to define a live fish portion thereof in which live fish which have been caught can be maintained in a live condition, said bait portion of the compartment being accessible to the live fish in the live fish portion of the compartment.

17. The combination of claim 16, wherein said lid means comprises a pair of lid sections each movable between open and closed positions independently of the other, one lid section overlying the bait portion of the well compartment and the other lid section overlying the live fish portion.

18. The combination of claim 16, wherein said pump means comprises means for discharging the fresh water into the well compartment in a spray above the water level therein to aerate the water in the compartment.

19. The combination of claim 16, wherein said pump means comprises:

an electric pump having a discharge side and an intake side disposed to receive water from a body of water; and a water supply conduit extending in the boat from the discharge side of the pump to the well compartment.

20. The combination of claim 19, wherein:

the boat includes a battery;

said pump means includes an electric pump motor and an electric circuit having a completed condition wherein the battery is electrically connected with said pump motor to energize same and an interrupted condition wherein the battery is electrically disconnected from the pump motor to deenergize same; and said circuit includes switch means for selectively effecting the completed and interrupted conditions of the circuit.

* * * * *